US006841924B1

(12) United States Patent
Skupien

(10) Patent No.: US 6,841,924 B1
(45) Date of Patent: Jan. 11, 2005

(54) LOW-VOLTAGE HIGH-RESOLUTION EINZEL GUN

(75) Inventor: Thomas A. Skupien, Frankfort, KY (US)

(73) Assignee: Intel Corporation, Santa Clara, CA (US)

( * ) Notice: Subject to any disclaimer, the term of this patent is extended or adjusted under 35 U.S.C. 154(b) by 0 days.

(21) Appl. No.: 09/433,062

(22) Filed: Nov. 3, 1999

(51) Int. Cl.[7] ..... H01J 29/51

(52) U.S. Cl. ..... 313/414; 313/409; 313/412; 313/426; 313/427; 313/447; 313/448; 313/451; 313/452; 313/456; 313/458; 313/449; 315/14; 315/15; 315/382

(58) Field of Search ..... 313/447–452, 313/414, 409, 426, 427

(56) References Cited

U.S. PATENT DOCUMENTS 3,863,091 A * 1/1975 Hurukawa et al. ..... 313/452
4,590,403 A 5/1986 Alig ..... 313/414
4,728,846 A 3/1988 Yasuda ..... 313/451
4,745,331 A * 5/1988 Alig ..... 313/414
5,077,498 A * 12/1991 Odenthal ..... 315/15
5,196,764 A * 3/1993 Kim et al. ..... 313/477 HC
5,204,585 A * 4/1993 Chen ..... 315/15
5,394,054 A * 2/1995 Chen et al. ..... 313/412
5,734,235 A * 3/1998 Noguchi ..... 315/382
5,894,190 A 4/1999 Hirota et al. ..... 313/409
5,990,610 A * 11/1999 Matsumoto et al. .... 174/137 B
6,025,674 A * 2/2000 Tojyou et al. ..... 313/414

FOREIGN PATENT DOCUMENTS

GB 2049989 * 12/1980 ..... G05B/24/02

* cited by examiner

*Primary Examiner*—Nimeshkumar D. Patel
*Assistant Examiner*—Sikha Roy
(74) *Attorney, Agent, or Firm*—Blakely, Sokoloff, Taylor & Zafman LLP

(57) ABSTRACT

A low voltage Einzel gun design maximizes the size of the second main lens to reduce spherical aberrations thereby reducing spot-size and improving focus quality. The gun's final accelerator electrode is formed as an internal conductive coating on the neck, which is connected to anode potential through an anode button. The jumper between the final and second accelerator electrodes is removed and the second accelerator electrode is connected through the high voltage stem pin to an external potential. Connection of the high voltage stem pin to anode potential defines an Einzel gun. The focus electrode is now connected to one of the low voltage stem pins. In a high voltage Einzel gun, connecting the second accelerator electrode and focus electrode to the high voltage and a low voltage stem pin, respectively, would cause arcing between the pins.

9 Claims, 6 Drawing Sheets

LOW-VOLTAGE HIGH-RESOLUTION EINZEL GUN

BACKGROUND OF THE INVENTION

1. Field of the Invention

This invention relates to electron gun design and more specifically to a technique for combining the benefits of a large main lens and an Einzel gun's dual-lens structure in a low voltage high-resolution Einzel gun.

2. Description of the Related Art

A CRT type electron gun is comprised of two or more optical parts; the triode and one or more focusing lenses. The triode is made up of the Emitter (cathode), the Wehnelt suppressor electrode (biasing grid) and the extractor electrode (first accelerator grid). The focusing lenses include a pre-focusing lens and one or more main lenses.

In the triode, the cathode's emission current is subject to two limitations. First, the cathode has a temperature limited emission current density, which varies widely from cathode to cathode. Differences in the cathode's activation and the tube's vacuum quality can change the temperature limit of the current density. Secondly, the cathode emission is subject to a space charge limitation at the surface of the cathode, which is determined by the physical geometry of the triode. Typically, the triodes are designed to operate in space charge limited conditions because physical geometry is more consistent and easier to control than the thermal emission properties of the cathode.

Under space charge limited conditions, the cathode is heated to a temperature that causes electrons to be emitted at the cathode surface. The electrons are then pushed back to the cathode surface by the suppressor electrode. But, the suppressor electrode has an optical aperture that allows an extraction voltage from the first accelerator to penetrate through the aperture and strip electrons off of the cathode. This structure produces a converging electron beam that crosses over at an axial position somewhere between the biasing grid and the first accelerator, typically referred to as the "first crossover".

The biasing grid effectively forms an iris, which the beam passes through. This iris can be opened or closed by varying the voltage on the biasing grid. If the biasing voltage is brought closer to the cathode voltage then the cathode's active emitting surface becomes larger in diameter. This active area serves as the object in the total optical system. While this voltage change allows more current to escape from the cathode it increases the object size for the optical system.

Increasing the extraction voltage on the first accelerating grid increases the biasing voltage required to "cutoff" the beam. This causes the active cathode surface to decrease in size but reduces the slope of the current vs. biasing voltage curve. This increase of the extraction voltage also increases the beam angle (increase in convergence before the first crossover or increase in divergence after the first crossover), which could be desirable or undesirable depending on the size of the main focusing lens.

The beam is sent through a series of focusing lenses (pre-focus lens, main lens, etc.) that focus the beam at the target. A lens is formed any time the beam is subjected to a change in the electric field and is typically constructed by sending the beam through two cylindrical shaped grids with differing voltages. The greater the potential difference between the grids the stronger the lensing effect. However, a stronger lens has more spherical aberration. Therefore, splitting the focusing between multi-pole lenses may be desirable.

A large beam is desirable because it has a steeper crossover angle at the first crossover, which reduces the spot size at the target. But, as the beam increases in size the spherical aberration affects increase the spot size. Thus, the Triode must be optimized for the best possible spot size for a given focusing lens system. Maximizing the main lens diameter will reduce spherical aberration.

Electron guns are typically given a name that describes their focusing lenses. A standard bi-potential gun has an Anode voltage and a focus voltage that together define a single focusing lens. As shown in FIG. 1, the standard Einzel gun 10 has a pre-focus lens 12 and two main lenses 14*a* and 14*b*.

Einzel gun 10 includes a second accelerator electrode 16 that follows a triode 18. The volume between the first accelerator electrode and the second accelerator electrode forms pre-focus lens 12. This combination of the triode and pre-focus lens is often referred to as the "Beam Forming Region" or "BFR," which is followed by the main lens system. In an Einzel gun the main lens system is split in to two main lenses 14*a* and 14*b*. The volume between second accelerator electrode 16 and a focus electrode 20 forms first main lens 14*a*. The volume between the focus electrode and a final accelerator electrode 22 forms second main lens 14*b*.

By definition, the second accelerator electrode and final accelerator electrode are both held at anode potential and the focus electrode is at a lower potential. The second accelerator electrode is electrically connected to the final accelerator electrode via a jumper 24. The final accelerator electrode is connected to an internal conductive coating 26 on the inside of the neck glass 28, which is held at anode potential, by a number of snubber springs 30. The diameter of the main lenses is limited to the space between the mounting beads 32*a* and 32*b*. The smaller the main lenses the greater the spherical aberration for a given beam size.

The Einzel gun uses a standard 14-position stem 34 of which 8–10 pins are typically used depending upon the placement of mounting beads. Nine low voltage pins 36 (2 filament, 1 cathode, 1–5 suppressor electrode, and 1 extractor electrode) are adjacent one another (only two of which are shown) and 1 high voltage pin 38 for the focus electrode is spaced apart on either side by 2 unused pins positions 40 to prevent arcing. High voltage pin 38 is connected to focus electrode 20 via a lead 42. The second and final accelerator electrodes are connected by internal jumper 24 and connected to anode potential through an anode button (not shown) in the neck.

Einzel guns are particularly well suited for applications that have a short focal length and a large beam deflection angle. Projection tubes, television and monitors operate at anode potentials >20 Kv and are generally considered to be high-voltage applications. Low-voltage applications, anode potential <12 Kv, include helmet mounted displays (HMDs) hand-held displays and displays that use a secondary emission target in place of a phosphor screen.

U.S. Pat. No. 5,894,190 to Hirota teaches a modified high-voltage Einzel Gun of the type shown in FIG. 2, in which the diameter of the main lens 44 has been increased thereby reducing spherical aberrations. Hirota's invention allows an increase to the main lens size by extending both the final accelerator electrode 46 and the focus electrode 48 forward past the end of the mounting beads 50. This allows the electrodes to maintain their standard mountings. For example, Hirota uses a jumper 52 between the second and final accelerator electrodes, which are then connected to anode potential by the anode button in the neck. The electrodes then have an increased diameter in the sections of the electrodes that are past the mounting beads. However, Hirota's Einzel gun still requires the final accelerator electrode to be smaller than the inside diameter of the neck glass.

As shown in FIG. 3, the standard bi-potential gun 54 contains a triode 56 and two additional electrodes. These electrodes are the focus electrode 58 (grid #3) and the final accelerator electrode 60 (grid #4). The volume between the first accelerator and the focus electrode forms a pre-focus lens 62, which in combination with the triode forms the Beam Forming Region. The main lens system is comprised of a single main lens 64, which is formed by the volume between the focus electrode and the final accelerator electrode. The final accelerator electrode is connected to an internal conductive coating 66 on the inside of the neck glass 68, which is held at anode potential, by a number of snubber springs 70. In the standard bi-potential gun the diameter of the main lens is limited to the space between the mounting beads 72.

As shown in FIG. 4, the bi-potential gun can be modified using internal conductive coating 66 on the neck glass 68 as the final accelerator electrode (grid #4). Unlike the Einzel gun, the final accelerator grid is not jumpered to any other electrode and thus can be replaced with the internal conductive coating. This extends the focus lens 64 past the end of the mounting beads 72 and allows the focus electrode 58 to maintain its standard mounting. The focus electrode has an increased diameter in the section of the electrode that is past the mounting beads. In fact, this configuration provides the maximum possible size for the single main lens, which reduces spherical aberrations.

U.S. Pat. No. 4,590,403 discloses another type of gun, the tri-potential gun that uses the internal conductive coating to define the final accelerator electrode, which as in the bi-potential gun is isolated from the other electrodes. Alig's gun has a triode and four more electrodes including the first focus electrode (grid #3), the decelerating electrode (grid #4), the second focus electrode (grid #5) and the final accelerating electrode (grid #6).

The volume between the first accelerator electrode and the first focus electrode forms a pre-focus lens, which in combination with the triode forms the Beam Forming Region. The main lens system is split into three main lenses. The volume between the first focus electrode and the decelerating electrode forms the first main lens. The volume between the decelerating electrode and the second focus electrode forms the second main lens. The volume between the second focus electrode and the final accelerating electrode forms the third main lens. This design improves the pre-focus lens and reduces spherical aberrations as compared to the Einzel gun and bi-potential gun.

SUMMARY OF THE INVENTION

In view of the above problems, the present invention provides a low voltage Einzel gun in which the size of the second main lens is maximized to reduce spherical aberrations thereby reducing spot-size and improving focus quality.

This is accomplished by forming the final accelerator electrode as an internal conductive coating on the neck, which is connected to anode potential through an anode button. The jumper between the final and second accelerator electrodes is removed and the second accelerator electrode is connected through the high voltage stem pin to an external potential. Connection of the high voltage stem pin to anode potential defines an Einzel gun. The focus electrode is now connected to one of the low voltage stem pins. In a traditional high voltage Einzel gun, connecting the focus electrode to a low voltage stem pin would cause arcing between the pins.

These and other features and advantages of the invention will be apparent to those skilled in the art from the following detailed description of preferred embodiments, taken together with the accompanying drawings, in which:

DETAILED DESCRIPTION OF THE INVENTION

This invention combines the benefits of the dual main lens structure of an Einzel gun with the advantages in main lens size previously only found in gun's such as the bi-potential and tri-potential that have an isolated final accelerator. This combination reduces spherical aberration and thus spot-size. However, the design that combines these advantages into a single Einzel gun is limited to low voltage applications, which is a relatively small yet important segment of the electron gun market.

Figure 1:
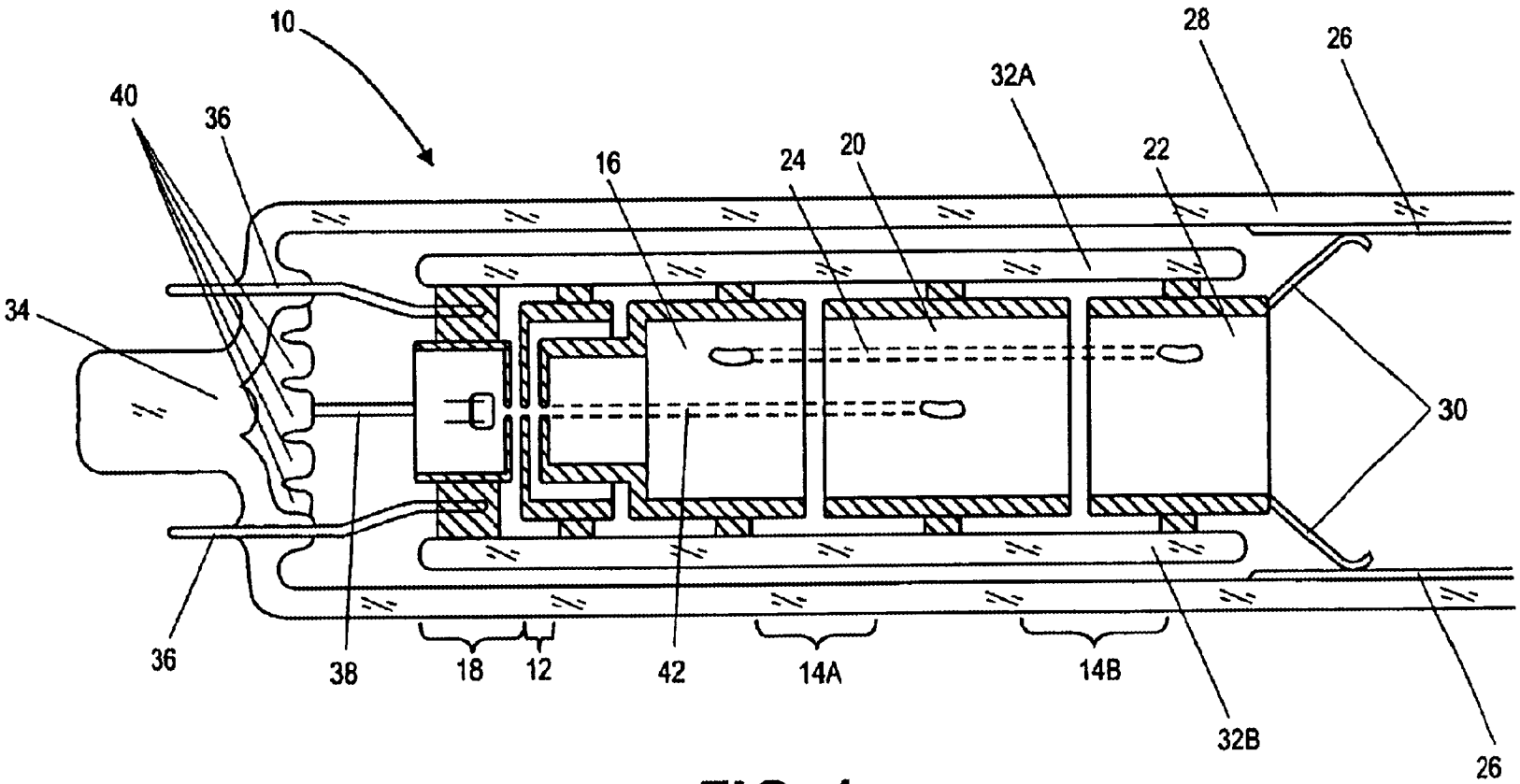
FIG. 1 (PRIOR ART)
FIG. 1, as described above, is a section view of a standard Einzel gun.
Figure 2:
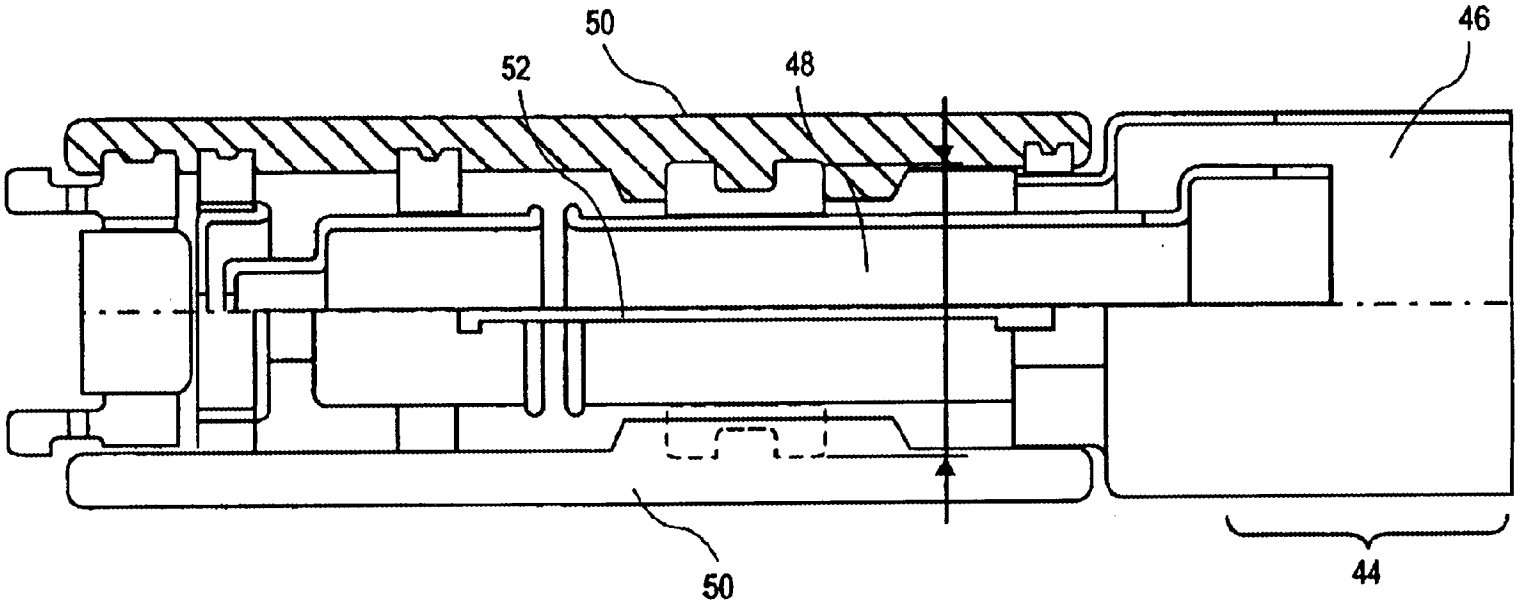
FIG. 2 (PRIOR ART)
FIG. 2, as described above, is a section view of Hirota's Einzel gun.
Figure 3:
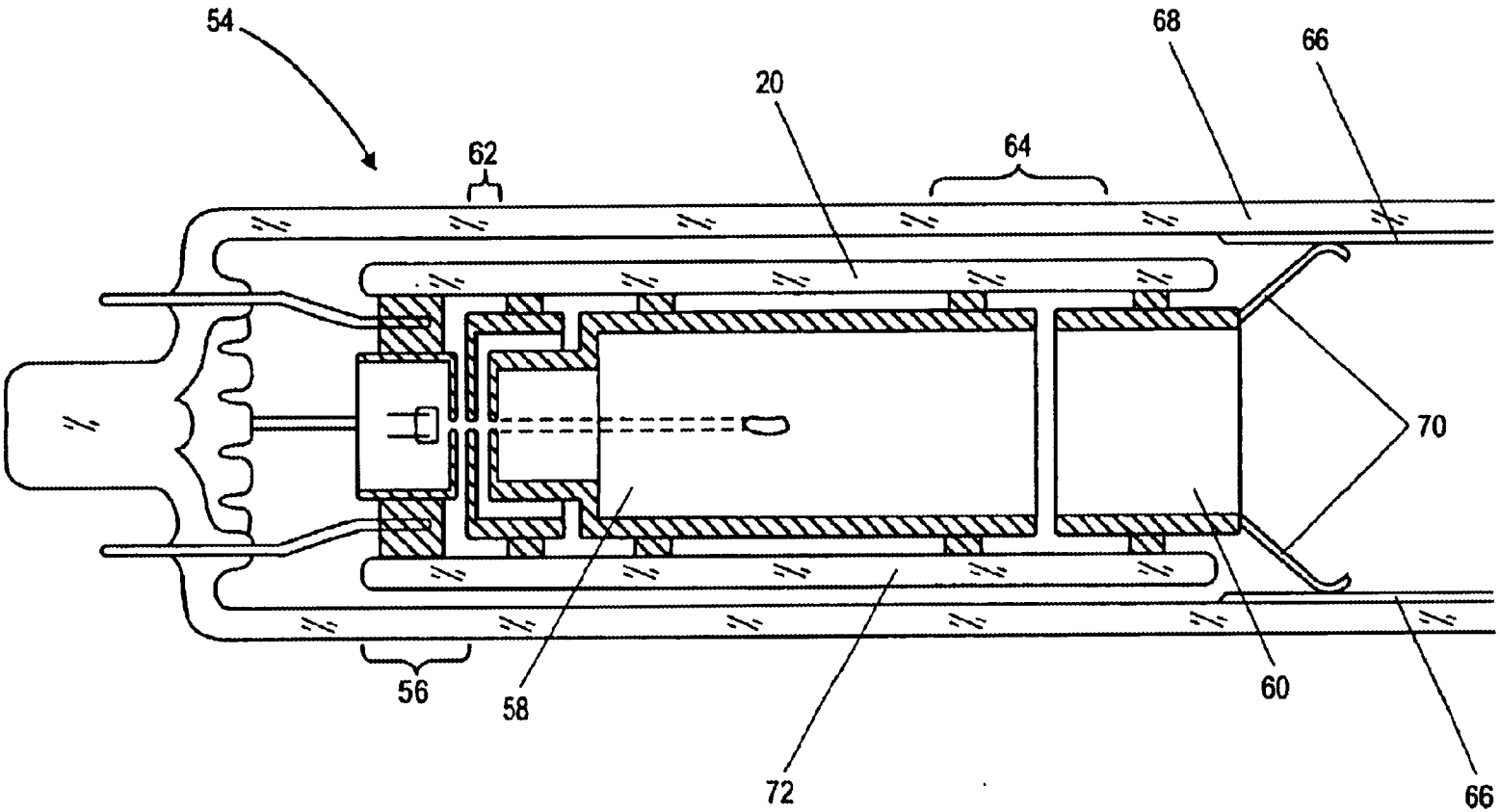
FIG. 3 (PRIOR ART)
FIG. 3, as described above, is a section view of a standard Bi-potential.
Figure 4:
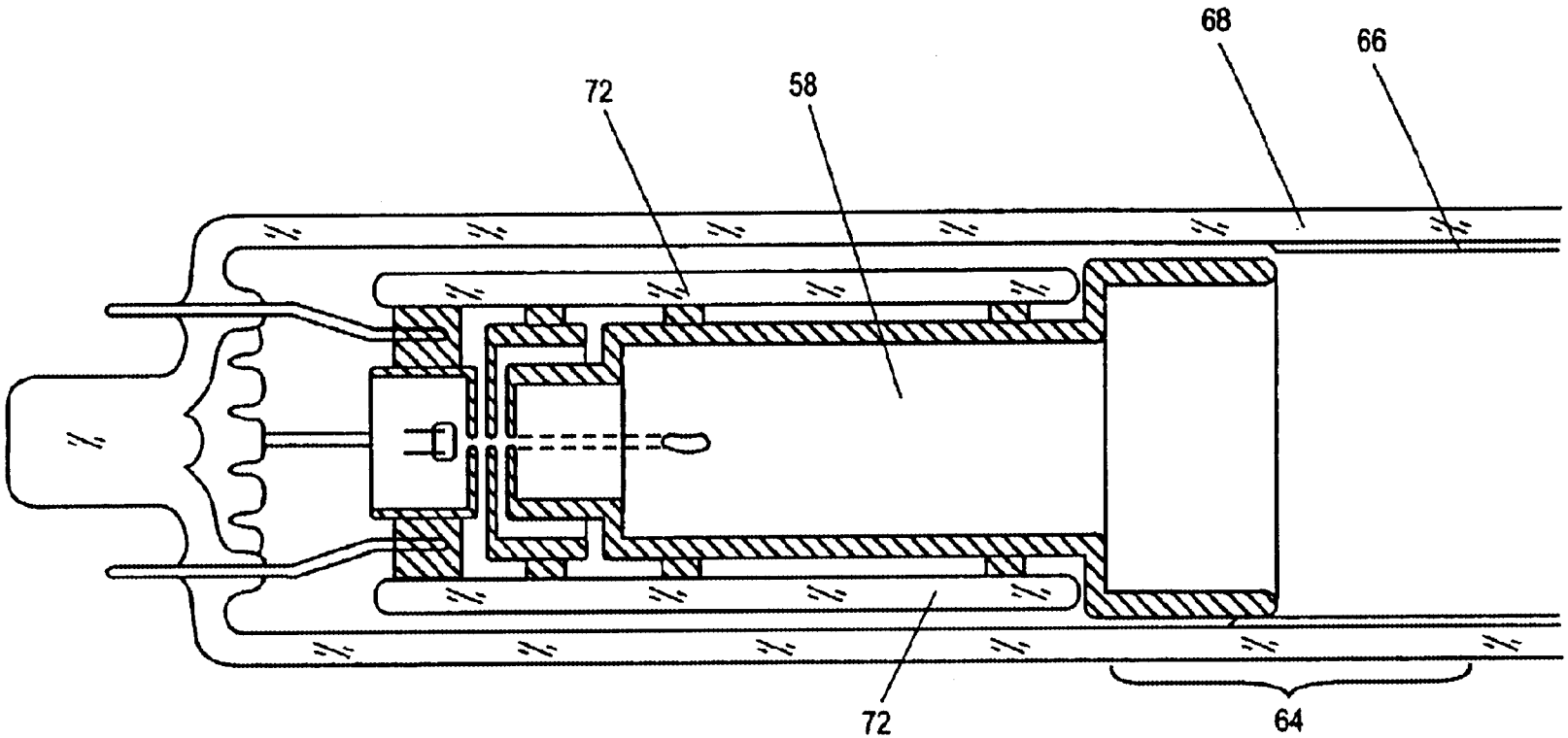
FIG. 4 (PRIOR ART)
FIG. 4, as described above, is a section view of a Bi-potential gun modified to enlarge the main lens.
Figure 5:
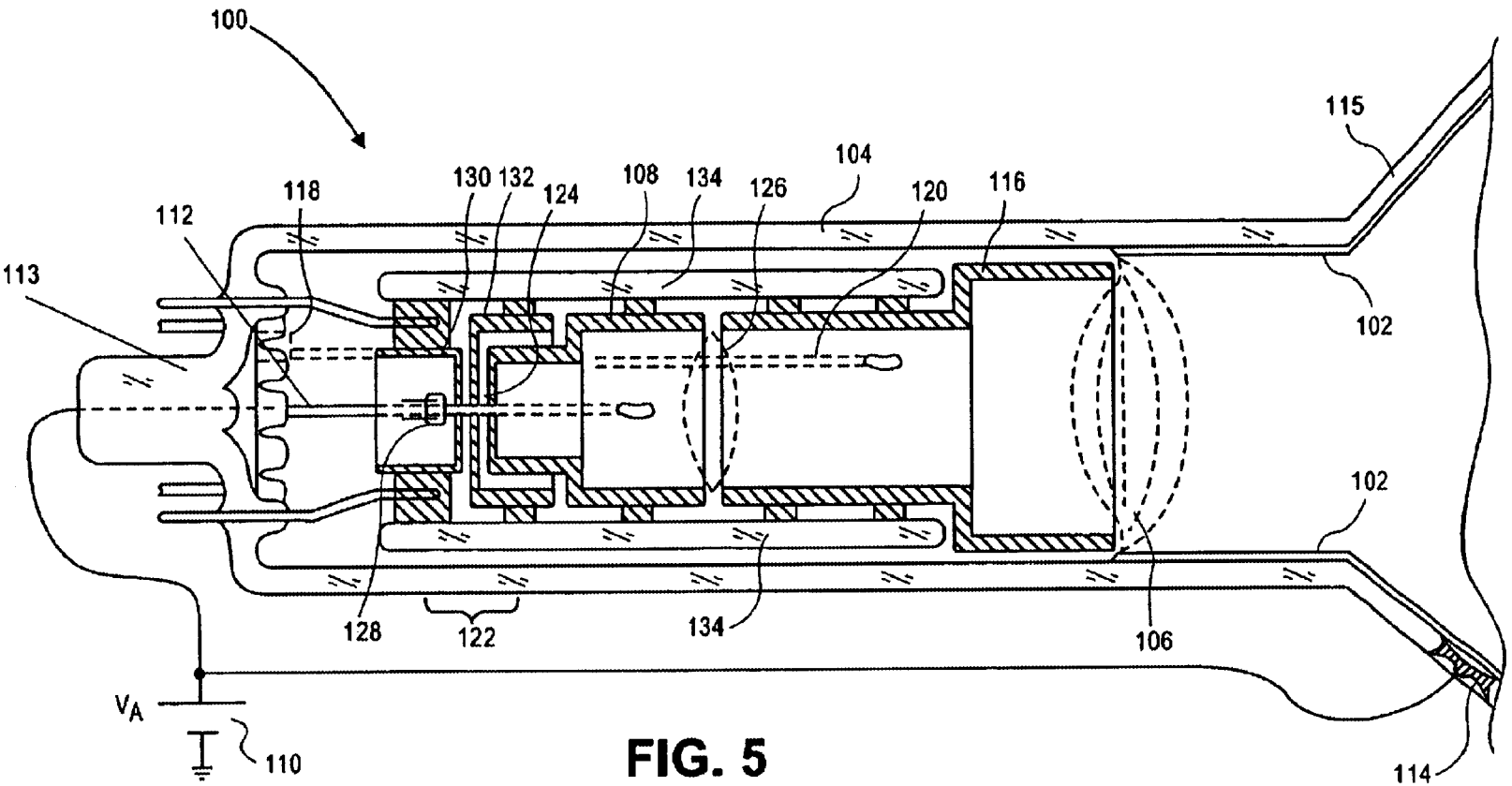
FIG. 5 is a section view of the low-voltage high-resolution Einzel gun modified to enlarge the main lens in accordance with the present invention.

As shown in FIG. 5, the low-voltage high-resolution Einzel gun 100 replaces the conductive cylinder used in standard Einzel guns to form a final accelerator electrode 102 with the internal conductive coating (also 102) on the neck glass 104 as is done in some bi-potential and tri-potential designs. This maximizes the diameter of the second main lens 106 for a given neck size thereby reducing spherical aberrations. The jumper that normally connects the final accelerator electrode to the second accelerator electrode 108 is removed. The electrical connections are made by connecting second accelerator electrode 108 and final accelerator electrode 102 to anode potential $V_A$ 110 outside the CRT via an isolated high voltage stem pin 112 in stem 113 and an anode button 114 in the funnel 115, respectively. Alternately, the high voltage stem pin can be connected to an external potential other than anode potential.

Since the second accelerator electrode occupies the high voltage stem pin, the focus electrode 116 must be connected to one of the non-isolated low voltage pins 118 via lead 120, which lie out of plane of the view shown and are thus shown as dashed lines. As a rule of thumb, to avoid arcing the voltage difference between any two adjacent pins should not exceed 2 kv. Thus, this Einzel gun design is limited to low voltage applications where the anode voltage is less than 12 kv.

More specifically, the low-voltage Einzel gun 100 is comprises a triode 122, a pre-focusing lens 124 and first and second main lenses, 126 and 106, respectively. Triode 122 is made up of an Emitter (cathode) 128, a Wehnelt suppressor electrode (biasing grid) 130 and an extractor electrode (first accelerator grid) 132. Under space charge limited conditions, cathode 128 is heated to a temperature that causes electrons to be emitted at the cathode surface.

Suppressor electrode 130 effectively forms an iris, which can be opened or closed by varying the voltage on the suppressor electrode. If the suppressor voltage is brought closer to the cathode voltage then the cathode's active emitting surface becomes larger in diameter. While this voltage change allows more current to escape from the cathode it increases the object size for the optical system.

First accelerator electrode 132 extracts the electrons through the iris. Increasing the extraction voltage on first accelerating grid 132 increases the biasing voltage required to "cutoff" the beam. This causes the active cathode surface to decrease in size but reduces the slope of the current vs. biasing voltage curve. This increase of the extraction voltage also increases the beam angle at the first crossover.

The beam is sent through pre-focus lens 124, first main lens 126 and second main lens 106 that focus the beam at the target. The volume between first accelerator electrode 132 and second accelerator electrode 108 forms pre-focus lens 124. This combination of the triode and pre-focus lens is often referred to as the Beam Forming Region, which is followed by the main lens system. The volume between second accelerator electrode 108 and focus electrode 116 forms first main lens 126. The volume between focus electrode 116 and final accelerator electrode 102 forms second main lens 106.

In a true Einzel gun, second accelerator electrode 108 and final accelerator electrode 102 are both held at anode potential 110 and focus electrode 116 is held at a lower potential. In the present design, final accelerator electrode 102 is the internal conductive coating, which would be very difficult to jumper to second accelerator electrode 108. Therefore, final accelerator electrode 102 is connected to the anode voltage 110 via anode button 114 in neck glass 104. Second accelerator grid 108 is connected to anode voltage 110 externally via lead 120 and high voltage stem pin 112. This design limitation constrains the present Einzel gun to low voltage applications. The benefit is that second main lens 106 extends past the end of the mounting beads 134 and allows focus electrode 116 to maintain its standard mounting. The focus electrode has an increased diameter in the section of the electrode that is past mounting beads 134. Furthermore, this configuration provides the maximum possible size for second main lens 106, which reduces spherical aberrations.

Figure 6:
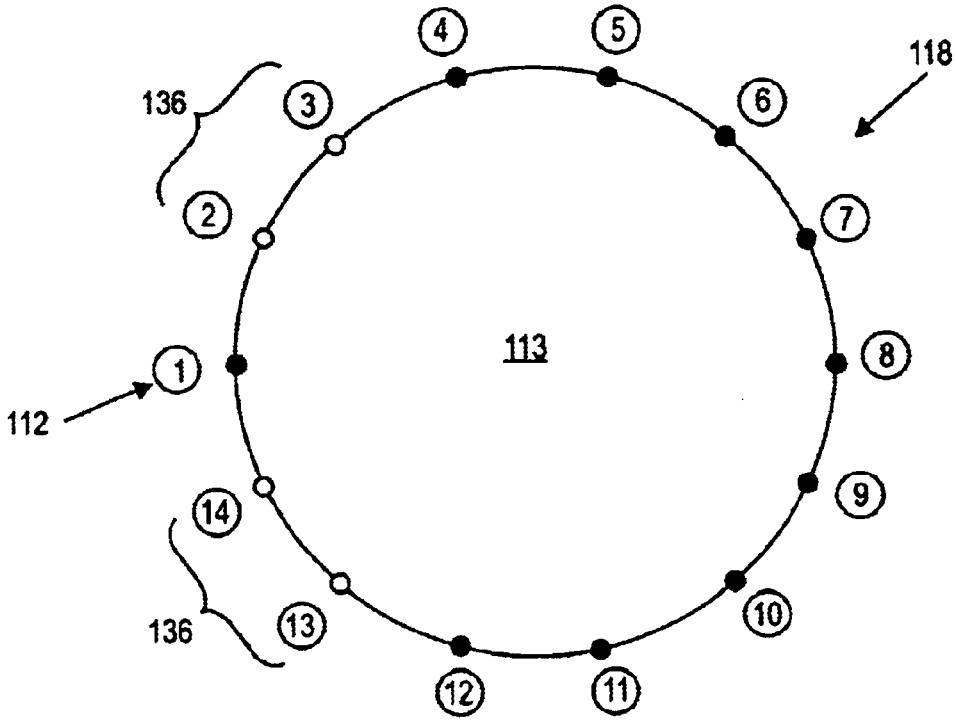
FIG. 6 is a diagram of the stem pin assignments for the modified low-voltage Einzel gun shown in FIG. 5.

As shown in FIG. 6, the present Einzel gun uses a standard 14-position stem 113 of which 9 pins are used with the present mounting structure. Nine low voltage pins 118 (2 filament, 1 cathode, 3 suppressor electrode, 1 extractor electrode, 1 focus electrode and 1 unused) are adjacent one another and 1 high voltage pin 112 for the second accelerator electrode is spaced apart on either side by 2 unused pins positions 136 to prevent arcing. For example, in the standard 14-pin rotation pin 1 is the high voltage pin, pins 2,3,13 and 14 are unused pin holes, pins 4,9 12 are suppressor electrode pins, pin 5 is the focus electrode pin, pins 6 and 7 are cathode filament pins, pin 8 is the cathode pin, and pin 10 is the first accelerator electrode pin. Of course, different pin assignments are possible as long as the second accelerator electrode pin is the high voltage pin and the focus electrode pin is placed to avoid arcing.

As described, the use of the internal conductive coating as the final accelerating electrode maximizes the diameter of the second main lens. This allows for a larger beam since the spherical aberration has been reduced. A large beam is desirable because it has a steeper crossover angle at the first crossover, which reduces the spot size at the target. But, as the beam increases in size the spherical aberration affects increase the spot size. Thus, the Triode must be optimized for the best possible spot size for a given focusing lens system. Maximizing the main lens diameter will reduce spherical aberration and improve resolution.

However, the use of the internal conductive coating as the final accelerating electrode eliminates the ability to use a jumper between the second accelerating electrode and the final accelerating electrode. So, the second accelerating electrode must receive its voltage through the stem pins. The stem pin assignment is arranged to match an industry standard except that the focus that previously used the isolated stem pin is moved to an unused pin and the anode now uses the isolated stem pin. Due to this pin configuration, this design is limited to low-voltage applications such as helmet mounted displays (HMDs) hand-held displays and displays that use a secondary emission target in place of a phosphor screen.

While several illustrative embodiments of the invention have been shown and described, numerous variations and alternate embodiments will occur to those skilled in the art. Such variations and alternate embodiments are contemplated, and can be made without departing from the spirit and scope of the invention as defined in the appended claims.

I claim:

1. A CRT including a neck and a funnel, the CRT comprising:

a stem with a number of low voltage stem pins and an isolated high voltage stem pin;

an electron gun positioned in the neck and including a triode that forms an electron beam, the triode comprising a cathode, a biasing electrode, and a first accelerator electrode;

a first lens comprising:

a second accelerator electrode including a conductive cylindrical element smaller in diameter than the neck, which is connected to an external potential via the isolated high voltage stem pin; and a focus electrode connected to a focus potential through one of the low voltage stem pins; and a second lens at the interface of the focus electrode and a continuous internal conductive coating on the neck and the funnel, wherein the internal conductive coating is connected to anode potential through an anode button in the neck.

2. The CRT of claim 1 wherein the external potential is an anode potential.

3. The CRT of claim 2 wherein the anode potential is less than or equal to twelve kilovolts.

4. A CRT including a neck and a funnel, the CRT comprising:

a stem with a number of low voltage stem pins and an isolated high voltage stem pin;

an electron gun positioned in the neck and including a triode that forms an electron beam, the triode comprising a cathode, a biasing electrode, and a first accelerator electrode;

a first lens comprising:

a second accelerator electrode including a conductive cylindrical element smaller in diameter than the neck, which is connected to an anode potential via the isolated high voltage stem pin; and a focus electrode connected to a focus potential through one of the low voltage stem pins; and a second lens at the interface of the focus electrode and a continuous internal conductive coating on the neck and the funnel, wherein the internal conductive coating is connected to anode potential through an anode button in the neck.

5. The CRT of claim 4 wherein the anode potential is less than or equal to twelve kilovolts.

6. A CRT including a neck and a funnel, the CRT comprising:

a stem with a number of low voltage stem pins and an isolated high voltage stem pin;

an electron gun positioned in the neck and including a triode that forms an electron beam, the triode comprising a cathode, a biasing electrode, and a first accelerator electrode;

a first lens comprising:

a second accelerator electrode including a conductive cylindrical element smaller in diameter than the neck, wherein the second accelerator electrode is connected to an anode potential via the isolated high voltage stem pin; and a focus electrode connected to a focus potential through one of the low voltage stem pins; and a second lens at the interface of the focus electrode and a continuous internal conductive coating on the neck and the funnel, wherein the internal conductive coating is connected to anode potential less than or equal to twelve kilovolts through an anode button in the neck.

7. An einzel focusing lens in a CRT including a neck and a funnel, the einzel focusing lens comprising:

a first lens comprising:

a second accelerator electrode including a conductive cylindrical element smaller in diameter than the neck, which is connected to an external potential via an isolated high voltage stem pin; and a focus electrode connected to a focus potential through a low voltage stem pin; and a second lens at the interface of the focus electrode and a continuous internal conductive coating on the neck and the funnel, wherein the internal conductive coating is connected to anode potential through an anode button in the neck.

8. The einzel focusing lens of claim 7 wherein the external potential is an anode potential.

9. The einzel focusing lens of claim 8 wherein the anode potential is less than or equal to twelve kilovolts.

* * * * *